US006557613B2

(12) United States Patent
Schmidt

(10) Patent No.: US 6,557,613 B2
(45) Date of Patent: May 6, 2003

(54) INSULATING GLASS ARRANGEMENT WITH A FOIL SHADE

(76) Inventor: Manfred Schmidt, Dachenhauserweg 37, D-71101 Schonaich (DE)

( * ) Notice: Subject to any disclaimer, the term of this patent is extended or adjusted under 35 U.S.C. 154(b) by 27 days.

(21) Appl. No.: 09/940,123

(22) Filed: Aug. 27, 2001

(65) Prior Publication Data

US 2002/0043348 A1 Apr. 18, 2002

(30) Foreign Application Priority Data

Sep. 21, 2000 (DE) ..... 200 16 562 U

(51) Int. Cl.[7] ..... A47H 1/00
(52) U.S. Cl. ..... 160/98; 160/245; 242/391.3
(58) Field of Search ..... 160/242, 243, 160/245, 98; 242/391, 391.3, 918

(56) References Cited

U.S. PATENT DOCUMENTS

| | | | | |
|---|---|---|---|---|
| 82,442 | A | * | 9/1868 | Seborn et al. |
| 116,929 | A | * | 7/1871 | Buckley |
| 690,650 | A | * | 1/1902 | Hansen |
| 922,151 | A | * | 5/1909 | Kelsey |
| 997,600 | A | * | 7/1911 | Cabral |
| 1,190,778 | A | * | 7/1916 | Leeper |
| 1,887,646 | A | * | 11/1932 | Johnston |
| 3,398,779 | A | * | 8/1968 | Kuss |
| 3,464,480 | A | * | 9/1969 | Kuss |
| 3,521,693 | A | * | 7/1970 | Kuss |
| 4,264,664 | A | * | 4/1981 | Kunz |
| 6,354,354 | B1 | * | 3/2002 | Schmidt |

FOREIGN PATENT DOCUMENTS

| | | |
|---|---|---|
| DE | A-2314013.8 | 10/1973 |
| EP | 0 483528 A1 | 9/1991 |

* cited by examiner

*Primary Examiner*—Blair M. Johnson
(74) *Attorney, Agent, or Firm*—Woodling, Krost & Rust

(57) ABSTRACT

The invention involves an insulating glass arrangement with at least one area between the panes, sealed up by glass panes (1, 1') and an edge layer connection (2), and with a foil shade located in the area between the panes consisting of a sun-blocking foil the end (40) of which is attached to one of the sides of the glass panes (1, 1') to be covered and which rolls up to a winding (41) on a movable winding shaft (3) or rolls out to a flat surface (42). It also consists of a winding drive unit for transmitting a torque to the winding shaft and of a lateral guide mechanism (5*a*, 5*b*) for guiding a bearing system of the winding shaft (3) along a linear path (S), and of a shade drive unit for actuating the foil shade. According to the invention, an internal linear guide mechanism (6*a*, 6*b*) is provided for aligning the winding shaft (3) at a right angle to the linear path (S).

16 Claims, 1 Drawing Sheet

INSULATING GLASS ARRANGEMENT WITH A FOIL SHADE

This application claims the benefit of German utility model patent application No. 200 16 562.3 filed Sep. 21, 2000.

FIELD OF THE INVENTION

The invention involves an insulating glass arrangement with a foil shade in accordance with the type indicated in the characterizing clause of Claim 1.

BACKGROUND OF THE INVENTION

Insulating glass is predominantly used today to glass in windows, facades or roofs of buildings. In its basic form, insulating glass consists of two panes that are connected to each other in a gas-tight way by spacers, so no moisture or dirt can get into the area between the panes. The spacing between the panes is around 20 mm, and this brings about good thermal insulation in terms of the thermal conductivity. Insulating glass can be equipped with a thermal protective layer as a screen against heat radiation. The glass lets less daylight shine through because of this, though, which is not desired because it's not natural.

Equipment that only provides sun blocking when needed is known in the form of shades, for example. In its basic form for a vertical installation position, the shade consists of a winding shaft located at the top for winding rolled hanging material up or down, as the case may be; its free-hanging end is weighted down by a rod. In the case of a slanted installation position, return-motion equipment is necessary that engages at the movable end and keeps the rolled hanging material taut.

Foil shades that use a thin sun-blocking film of plastic with a reflecting coating offer especially effective protection against the sun.

Furthermore, insulating glass arrangements are known that have a foil shade in the area between the panes to block the sun. DE-A-23 14 013.8 and EP 0 483 528, for example, describe combinations of this sort of shades and insulating glass; the second reference involves a solution especially for a slanted installation position. It goes without saying that the foil shades considered here have to be built in an extremely compact way. A winding shaft with a very small diameter and a thin sun-blocking foil, to also keep the diameter of the winding small in the case of a relatively high number of windings, are characteristic of the compact design. The compact design has problems, though, for the following reasons:

1. A thin winding shaft has a small load-bearing capacity, which heavily limits the maximum possible width and length of the foil shade.
2. A thin sun-blocking foil that is moved along a glass pane can be attracted by the glass due to electrostatic effects and stick to it.

The electrostatic effects are particularly difficult to deal with in the case of slanted installation position, because the sun-blocking foil does not hang freely here, but instead lies on the lower pane and causes friction. An electrostatic force of attraction between the foil and the glass arises because of this, which can have substantial negative effects on the functioning of the foil shade.

SUMMARY OF THE INVENTION

The task of creating insulating glass with an internal foil shade for temporarily blocking the sun on the glass surface, which avoids the disadvantages described above and especially implements a precise guide mechanism for true-tracking winding of a thin foil with a small winding diameter over a high number of windings, forms the basis of the invention.

This problem is solved by the distinguishing features of Claim 1, in combination with the features of the characterizing clause.

Further advantages and design forms of the invention result in the subclaims.

The insulating glass uses an extremely compact foil shade in which a thin sun-blocking foil, as the rolled hanging material, is wound up on a shaft with a small diameter into a winding that fits in the area between the panes, or is unwound into a flat sheet. It distinguishes itself above all by a winding shaft on bearings that is moved linearly, which avoids sliding friction between the sun-blocking foil and the glass surface, and by a synchronized device that ensures true-tracking winding over many layers and with an extremely small winding diameter.

In contrast to known insulating glass with an internal shade device, in which rolled hanging material is rolled down or up by a fixed winding shaft, the winding shaft is the part that moves here, and the sun-blocking foil is fixed at the end of the rolled-out part, so that the entire rolled-out surface hangs without movement, or is up against the glass surface, depending on the installation position of the insulating glass.

It's true that this arrangement is more complicated with regard to the movable bearings of the winding shaft but, on the other hand, special advantages result that are significant for the combination of foil shade and insulation glass being considered here. In particular, the problems described above are completely solved here and, in fact, for the following reasons:

Regarding a): Load-bearing capacity of the winding shaft. The winding shaft is located at the lower end of the sun-blocking foil, where it has no support function or the winding is lying flat on the lower glass surface, both in a vertical, as well as in a slanted installation position, respectively.

Regarding b): Electrostatic effects.

Electrostatic effects are ruled out or are meaningless for the functional capability, because the rolled-down surface of the sun-blocking foil does not generate any sliding friction.

Furthermore, the fact that the sun-blocking foil is exposed to substantially less tensile forces and other mechanical loads results from the avoidance of the sliding friction on it. It can therefore be made out of extremely thin material, which is another advantage with regard to the compact design required here.

It consequently turns out, for the reasons mentioned above, that the arrangement permits the use of a winding shaft with a small diameter and a thin sun-blocking foil. On the other hand, experience with experimental samples has shown that winding up an adequately wide and long sun-blocking foil causes problems on a thin winding shaft.

It has been shown that the foil doesn't always wind up in a true-tracking way when there are a high number of windings that are forced to arise due to the extremely small winding diameter. Further, this problem is aggravated even more because a lateral guide mechanism, which is customary for shades with larger dimensions, does not represent a solution for the very thin and therefore weak sun-blocking foil used here.

The invention solves this problem with an internal, linear guide mechanism to align the winding shaft at a right angle to a linear path, in order to ensure true-tracking winding of the sun-blocking foil when there is a small winding diameter and over many layers.

The sun-blocking foil has a thickness of 0.01 to 0.07 mm here, and the winding shaft has a diameter in the range of 5 to 15 mm. The sun-blocking foil is preferably made out of polyester. In one variation, the sun-blocking foil has a design characteristic in the form of a type of winding that has a torque, as a spring drive, in the direction of rotation of being rolled up. Another variation of the design involves kink characteristics.

A linear guide mechanism is realized in the form of a cord-control system, consisting of two cords that are guided via deflection rollers on the sides along the side guidance mechanism and in a synchronous way over a crossing from side to side. This means that both bearings of the winding shaft are fixed at a right angle to the linear path and guided synchronously in the movement process.

In a special design form, the cord-control system is simultaneously a drive unit for moving the winding shaft long the linear path. The cords are designed in the form of drive belts for this, and the deflection rollers in the form of drive wheels, and a shade drive unit in the form of an electrical motor is coupled to one or more of the drive wheels to drive the foil shade.

In one design form, the winding drive unit consists of two running wheels that roll in the lateral guide mechanism on the left or the right-hand side and are connected to the winding shaft by an overrunning clutch and a friction clutch, also in combination, and that transmit a torque. The two running wheels have diameters of different sizes in one variation and are connected to the winding shaft via an overrunning and friction clutch in each case. During the rolling-up process, only the smaller running wheel transmits the torque to the winding shaft, and during the rolling-down process, only the larger running wheel, and thereby the one turning more slowly, transmits the torque.

In one variation of the shade drive unit, an electrical motor is located at the movable bearings of the winding shaft. This means that when actuated, the electrical motor moves along the linear path together with the winding shaft.

In another variation, the shade drive unit consists of a magnetic coupling that is located at the movable bearings of the winding shaft and that transmits a pushing force through one of the two glass panes.

The invention will be described more precisely below with the aid of the design examples presented in the drawing. The terms and assigned reference symbols used in the list of reference symbols provided below are applied in the description, in the patent claims and in the drawing.

DESCRIPTION OF THE INVENTION

Figure 1:
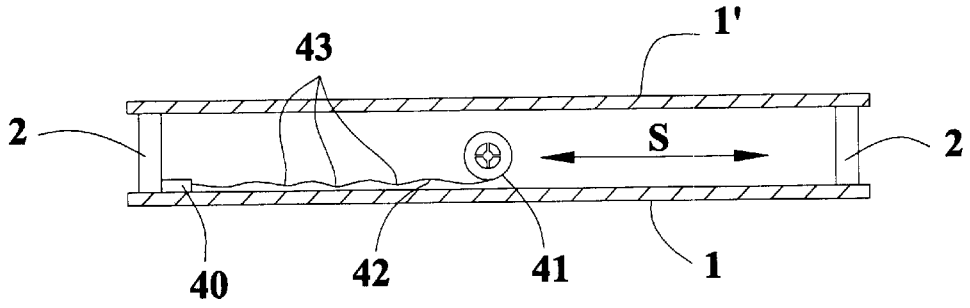
FIG. 1 shows a basic arrangement of the shade foil in the area of insulating glass between the panes and FIG. 2 shows a schematic diagram of a linear guide mechanism.

An insulating glass arrangement is shown in a cross-sectional view in FIG. 1 that consists of the glass panes 1 and 1' and the edge layer connection 2. A foil shade for temporary sun-blocking of the glass surfaces is located between the two glass panes 1, 1'; the spacing between the panes is around 20 mm. The foil shade uses a thin sun-blocking film made of plastic with a reflective coating.

In contrast to customary shades in which rolled hanging material is rolled down or up by a fixed winding shaft, the winding 41 is the part that moves here, and the sun-blocking foil is fixed at the end 40 of the flat surface 42 of the rolled-out part.

When being rolled up or down, the winding 41 moves along a linear path S; the entire rolled-out flat surface 42 hangs without movement or lies up against the glass surface, depending on the installation position of the insulating glass.

In one variation, the sun-blocking foil has a design characteristic in the form of a winding 41 of a sort that has a torque in the direction of rotation of winding, as a spring drive. In a different design, the sun-blocking foil has kink characteristics 43 that form a zigzag or wave profile in the rolled-out flat surface 42.

Figure 2:
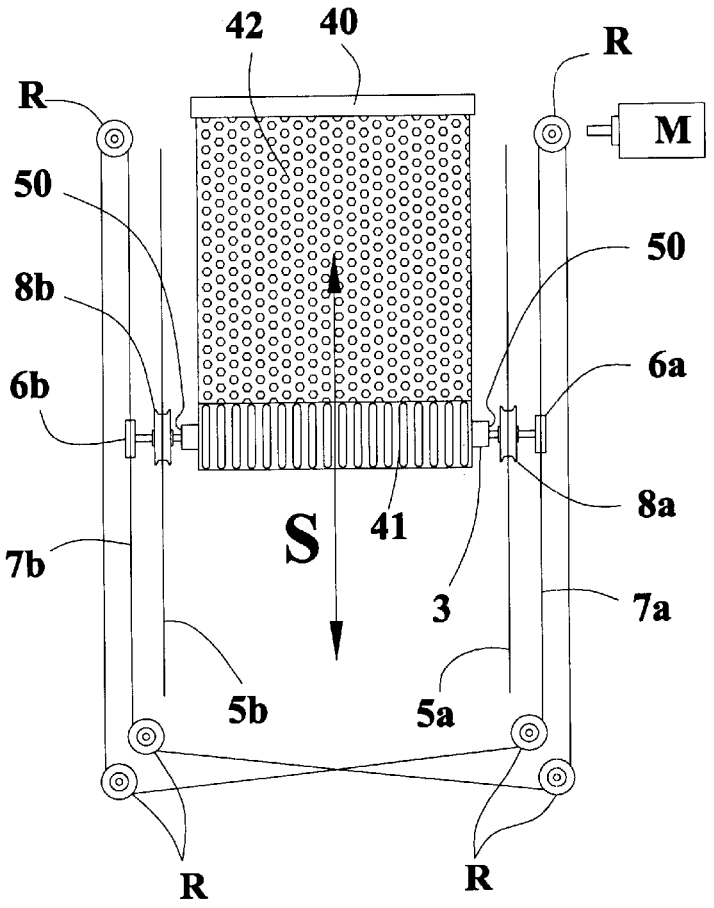

A mechanism for guiding the winding 41 along the linear path S is presented schematically in FIG. 2. The winding shaft 3 is supported in bearings on the sides so as to be able to rotate, and the lateral guiding of the bearings along the linear path S is accomplished here by a lateral guide mechanism 5*a* or 5*b* on the right and left-hand side. The linear guide mechanism 6*a*, 6*b* is required so that the rolled-out flat surface 42 of the thin sun-blocking foil winds up in a dependable and true-tracking way over many layers and with a small winding diameter. It causes the winding shaft 3 to be exactly aligned at a right angle to the linear path S.

In the design form that is presented, the linear guide mechanism 6*a*, 6*b* consists of two cords 7*a*, 7*b* that are guided via deflection rollers R along the lateral guide mechanism 5*a*, 5*b* and in a crossing from side to side. In one variation, this linear guide mechanism 6*a*, 6*b* can also be used to move the winding shaft 3 along the linear path S.

The cords 7*a*, 7*b* are designed to be drive belts for this, and the deflection rollers R as drive wheels; an electrical motor M is coupled to one or more of the drive wheels as a shade drive unit.

In one variation of the lateral guide mechanism 5*a*, 5*b*, this can also be used for the winding drive unit. The winding drive unit that is presented consists of two running wheels 8*a*, 8*b* that roll in the lateral guide mechanism 5*a* or 5*b* on the right and left-hand side and deliver the torque for rolling to the winding shaft 3. Because the winding drive unit is only permitted to have a torque in the direction of rotation of rolling up and the tensile force on the sun-blocking foil is to be as small as possible, an overrunning clutch and a friction clutch are provided between the running wheels 8*a*, 8*b* and the winding shaft 3. The overrunning clutch and a friction clutch can, of course, also be realized in combination with one another.

In a further variation, the two running wheels 8*a*, 8*b* have different diameters and are individually coupled to the winding shaft 3 via an overrunning clutch and a friction clutch. The smaller, and therefore more rapidly turning, running wheel 8*a* is consequently coupled to the winding shaft 3 in the winding-up process; whereas the larger, and therefore more slowly turning, running wheel 8*b* is coupled during the rolling-out process. The rotary movement of the winding shaft 3 originating from the pulling tension of the sun-blocking foil is braked in this way during the rolling-out process.

REFERENCE SYMBOL LIST

1, 1' Glass pane front, back
2 Edge layer connection
3 Winding shaft
40 End

41 Winding
42 Flat surface
43 Kink characteristic
5*a*, 5*b* Lateral guide mechanism right, left
6*a*, 6*b* Linear guide mechanism right, left
7*a*, 7*b* Cord right, left
8*a*, 8*b* Running wheel right, left
R Deflection rollers
M Electrical motor
S Linear path The invention has been set forth with particularity herein. Those skilled in the art will readily recognize that changes and modifications may be made to the invention without departing from the spirit and scope of the appended claims.

I claim:

1. Insulating glass arrangement comprising glass panes (1, 1') separated so as to form at least one area between said panes, said area sealed up by said glass panes (1, 1') and an edge layer connection (2), a foil shade, said foil shade located in said area between said panes comprising a sun-blocking foil the end (40) of which is attached to one of the sides of the glass panes (1, 1') to be covered and which rolls up on a winding (41) on a movable winding shaft (3) or rolls out to a flat surface (42), a winding drive unit for transmitting a torque to the winding shaft and a lateral guide mechanism (5*a*, 5*b*) for guiding a bearing system of the winding shaft (3) along a linear path (S), and a shade drive unit for actuating the foil shade, and, an internal linear guide mechanism (6*a*, 6*b*) for aligning the winding shaft (3) at a right angle to the linear path (S).

2. Insulating glass arrangement according to claim 1, characterized by said sun-blocking foil having a thickness of 0.01 to 0.07 mm.

3. Insulating glass arrangement according to claim 1, characterized by said winding shaft (3) having a diameter of 5 to 15 mm.

4. Insulating glass arrangement according to claim 2, characterized by said winding shaft (3) having a diameter of 5 to 15 mm.

5. Insulating glass arrangement according to claim 1, characterized by the sun-blocking foil being made of polyester.

6. Insulating glass arrangement according to claim 2, characterized by the sun-blocking foil being made of polyester.

7. Insulating glass arrangement according to claim 3, characterized by the sun-blocking foil being made of polyester.

8. Insulating glass arrangement according to claim 4, characterized by the sun-blocking foil being made of polyester.

9. Insulating glass arrangement according to claim 1, characterized by the sun-blocking foil having a design in the form of a spring drive winding (41) such that it has a torque in the direction of rotation of the rolling-up process.

10. Insulating glass arrangement according to claim 1, characterized by the sun-blocking foil having design in the form of kink characteristics (43).

11. Insulating glass arrangement according to claim 1, characterized by two bearings of the winding shaft and wherein said linear guide mechanism (6*a*, 6*b*) is in the form of a cord-control system comprising two cords (7*a*, 7*b*) guided via two deflection rollers (R) at the sides along the lateral guide mechanism (5*a*, 5*b*) and crossing from side to side such that said two bearings of the winding shaft (3) are synchronized in their movement process.

12. Insulating glass arrangement according to claim 11 and with said linear guide mechanism (6), characterized by the cords (7*a*, 7*b*) being designed as drive belt, and the deflection rollers (R) being designed as drive belt wheels, for transmitting driving power, and by the shade drive unit in the form of an electrical motor (M) being coupled to one or more deflection rollers (R).

13. Insulating glass arrangement according to claim 2, characterized by the sun-blocking foil having a design in the form of a spring drive winding (41) such that it has a torque in the direction of rotation of the rolling-up process.

14. Insulating glass arrangement according to claim 3, characterized by the sun-blocking foil having a design in the form of a spring drive winding (41) such that it has a torque in the direction of rotation of the rolling-up process.

15. Insulating glass arrangement according to claim 4, characterized by the sun-blocking foil having a design in the form of a spring drive winding (41) such that it has a torque in the direction of rotation of the rolling-up process.

16. Insulating glass arrangement according to claim 2, characterized by the sun-blocking foil having design in the form of kink characteristics (43).

* * * * *